US006776687B2

(12) United States Patent
Becking

(10) Patent No.: US 6,776,687 B2
(45) Date of Patent: Aug. 17, 2004

(54) HAUNTING AID

(76) Inventor: Frank P. Becking, 422 Buena Vista Ave., Redwood City, CA (US) 94061

( * ) Notice: Subject to any disclaimer, the term of this patent is extended or adjusted under 35 U.S.C. 154(b) by 0 days.

(21) Appl. No.: 10/269,564

(22) Filed: Oct. 11, 2002

(65) Prior Publication Data

US 2003/0143918 A1 Jul. 31, 2003

Related U.S. Application Data

(60) Provisional application No. 60/329,135, filed on Oct. 11, 2001.

(51) Int. Cl.[7] ..... G09F 13/00; A63H 33/26

(52) U.S. Cl. ..... 446/485; 446/391; 446/392; 40/540; 362/249

(58) Field of Search ..... 40/431, 442, 569, 40/540; 446/485, 219, 391; 362/249

(56) References Cited

U.S. PATENT DOCUMENTS

| | | | | | |
|---|---|---|---|---|---|
| 2,428,133 | A | * | 9/1947 | Yogan | 40/540 |
| 2,647,222 | A | * | 7/1953 | Nieset | 315/228 |
| 2,699,621 | A | * | 1/1955 | Levinson | 40/427 |
| 3,250,910 | A | * | 5/1966 | Authier | 40/540 |
| 3,294,397 | A | * | 12/1966 | Du Rand | 472/133 |
| 3,812,614 | A | * | 5/1974 | Harrington | 446/47 |
| 4,263,743 | A | * | 4/1981 | Hanson et al. | 446/329 |
| 4,337,504 | A | * | 6/1982 | Simpson | 362/104 |
| 4,480,293 | A | * | 10/1984 | Wells | 362/108 |
| 4,734,074 | A | * | 3/1988 | Kinberg et al. | 446/184 |
| 4,836,823 | A | * | 6/1989 | Laven | 446/485 |
| 5,099,592 | A | * | 3/1992 | Layne | 40/540 |
| 5,158,356 | A | * | 10/1992 | Guthrie | 362/188 |
| 5,408,764 | A | * | 4/1995 | Wut | 36/137 |
| 5,566,483 | A | * | 10/1996 | Ogren | 40/564 |
| 5,584,741 | A | * | 12/1996 | Cheung | 446/300 |
| 5,984,098 | A | * | 11/1999 | Cahen et al. | 206/457 |
| 6,070,990 | A | * | 6/2000 | Dalton et al. | 362/201 |
| 6,275,384 | B1 | * | 8/2001 | Kuo | 361/752 |
| 2003/0019138 | A1 | * | 1/2003 | Lin | |

* cited by examiner

*Primary Examiner*—Derris H. Banks
*Assistant Examiner*—Dmitry Suhol

(57) ABSTRACT

A face with glowing eyes returns stare or blinks at onlookers. At least the head of a being or creature is provided on a backing with a pair of LEDs positioned in empty sockets or under evil brows. The base of each LED rests against or is placed adjacent to the front of the backing, while electrical leads on the other side secure the LEDs in place. The approach to prop construction described may also be employed for less sinister purposes.

6 Claims, 2 Drawing Sheets

HAUNTING AID

FIELD OF THE INVENTION

This relates to components for spooky entertainment, particularly those suited for haunting mortals, for example, on all hallows eve.

BACKGROUND OF THE INVENTION

It is well known that a key component to hosting adequate Halloween festivities is supplied by scary props. A traditional set piece is the jack-o-lantern. Depictions of skulls, ghosts, devils, witches and the like are other favorites. Some of these depictions include lighted eyes in effort to produce a macabre appearance.

Unfortunately, one needs to be a grave robber in order to afford the lit-up props available today. The present invention is poised to kill this trend. The invention may even be useful in producing mass-hysteria. It may also find use for other festive occasions, by with different effect.

SUMMARY OF THE INVENTION

The present invention includes heads, portions of heads or faces depicted on inexpensive panels, sheets or layers of material with light emitting diodes (LEDs) positioned to simulate eyes. While it may be preferred in many instances, the heads need not be dismembered. Accordingly, the invention may include complete (if often somewhat decayed or devoured) figures with glowing eyes. The LED's may burn steadily, staring unnervingly at onlookers. Alternately, they may blink or wink with cunning. The efficient construction of props as described herein ensure that that the main cost to consumers comes in terms of lost sleep.

BRIEF DESCRIPTION OF THE DRAWINGS

Each of the following figures diagrammatically illustrates blood-curdling aspects of the present invention.

DETAILED DESCRIPTION

Figure 1:
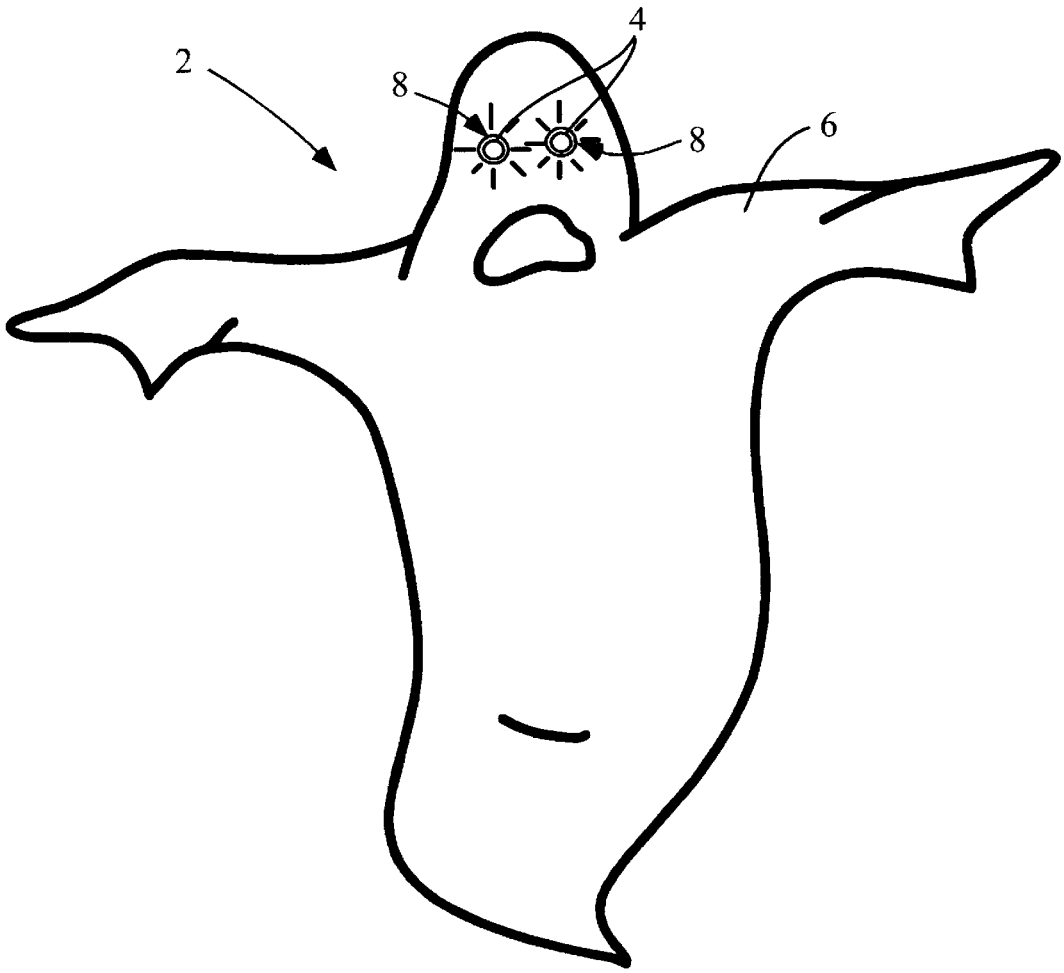
FIG. 1 shows a lighted figure according to the present invention from the front.

The terrifying prop 2 shown in FIG. 1 includes glowing "eyes" provided by a pair of Light Emitting Diodes (LEDs) 4 set against a backing 6. The ghost depicted is merely one of the many examples of beings such as haunting creatures or portions of creatures that may be used in the invention. Others include jack-o-lanterns and skeletons, devils, reapers, witches, warlocks, ghouls, goblins, mummies, zombies, werewolves, vampires, lepers and their heads. Still others creatures, beings or portions thereof may be portrayed or depicted on backing 6.

The head or figure shown may set to float in space or a window for display. Alternately, it may be hung from a tree or be impaled on a stick, sword, pike or another gruesome implement for display.

Regardless, preferred materials for backing 6 include plastic sheet, card stock or posterboard. Preferably, backing 6 comprises a flat panel or is provided in low relief in order to conserve material and manufacturing costs. The base 8 of each LED is preferably set flush against adjacent portions of the backing. This provides a finished appearance to the product.

The use of LEDs in prop 2 is advantageous for other reasons as well. Any of a variety of LED shapes (e.g., rounded, cylindrical, rectangular, etc.) or sizes may be employed with great effect. Also, LEDs come in a variety of colors, with dual-color, blinking and steady-burning types available. Naturally, the choice of LEDs will depend on the type of head or figure depicted. For instance, yellow LED eyes have a rather eerie appearance that pair well with the bleached bones of a skull. For some reason, red eyes make werewolves howl, while green eyes make ghosts positively haunting.

Figure 2A:
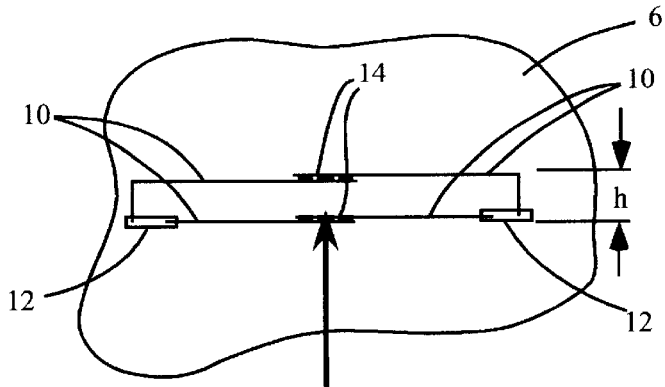
FIGS. 2A–2C shows the guts of variations of the invention from the rear in association with sections of backing material.
Figure 2B:
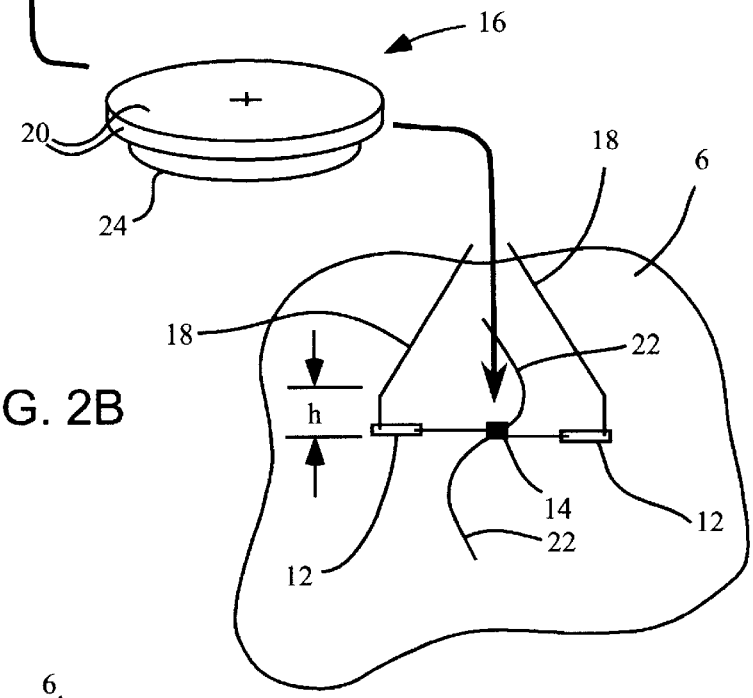
Figure 2C:
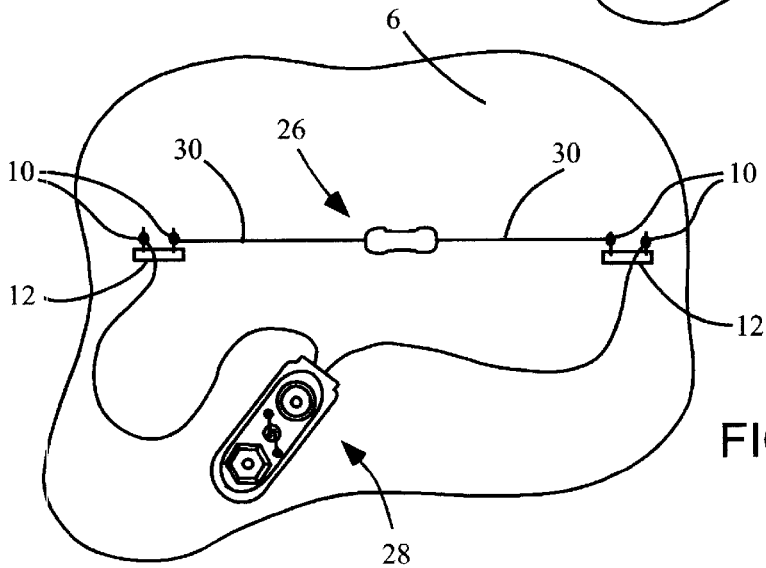

FIGS. 2A–2C show the maniacal workings of how prop 2. The electrodes 10 of each LED pass through a slit or hole 12 in backing 6. In FIGS. 2A and 2B parallel-type circuits are disclosed. FIG. 2C shows a series-type circuit.

In FIG. 2A, the anodes from each LED are connected by solder 14 as are the cathodes. To animate the prop, battery 16 is simply slipped between the electrodes as indicated by the upper arrow. The offset height (h) of the electrode segment before the bend on either side of the device is preferably set to provide a spring action between the electrodes to capture the battery, simultaneously making electrical contact and holding it in place. However, tape or other supplemental retention means may also be employed.

The configuration shown in FIG. 2A is advantageous when the LED spacing is somewhat larger that the battery diameter. A preferred battery for use in the variation shown in FIGS. 2A and 2B is a type 2430 Lithium Ion "coin cell." Its 24 mm diameter, 3 mm thickness and nominal 3V rating with opposing "+" and "−" provide and advantageous combination to work with. The battery stores adequate energy for frightfully long LED bum. Yet, it is thin enough that offset (h) shown in either of FIGS. 2A an 2B does extend very far from the backing thereby facilitating handling and mounting from behind. Still, other battery types are contemplated for use in these variations. For instance, a thicker 24 mm battery, such as the 5 mm thick 2450 type cell may be used where longer LED "life" is desired.

When the spacing between the LEDs is smaller than the diameter of the battery to be used, the variation shown in FIG. 2B has certain advantages. However, due to the nature of the coin cell battery format, LED anode and cathode arrangement is not as easily interchangeable as with the variation in FIG. 2A. In the variation of FIG. 2B, the anodes 18 includes offset (h). This avoids shorting the battery upon its insertion as indicated by the lower arrow into the cradle the electrodes form since both the face and periphery of a coin cell battery typically define the battery anode 20. The LED cathodes 22 of the variation in FIG. 2B are shown joined by solder 14. The upper LED cathode 22 is bent upward to contact battery cathode 24. The lower LED cathode 22 is shown bent in an opposite manner to help stabilize the LEDs and the battery when it is in place.

The variation of the invention shown in FIG. 2C is a series-type circuit adapted for use with a common 9V battery. To handle the increased voltage with common LEDs, a current-limiting resistor 26 is provided. The characteristics of the resistor will vary depending on the LEDs type used, but one with skill in the art can easily determine this. The leads of both the resistor and a 9V battery connector 28 are shown soldered to trimmed LED electrodes 10. As with the electrode elements positioned against backing 6 shown in FIGS. 2A and 2B, the electrodes in FIG. 2C are used to secure the LEDs to the backing. In FIG. 2C, they do so in large part by way of their connection to resistor leads 30.

Of course, various modifications can be made to the systems shown in FIGS. 2A–2C. For instance, instead of adapting a parallel-type LED arrangement for use with a coin cell as shown in FIGS. 2A and 2B, it may be setup for use with a battery housing containing AA or AAA batteries. Still further, LEDs able to handle more than 3V without damage may be used, in which case other battery arrangements may be implemented in a parallel LED connection setup. Also, where greater distance is desired between LED eyes, extension wire segments may be employed to bridge such elements as shown in the figures. Numerous other arrangements in terms of battery connection and wiring may also be employed.

Regarding the construction of the invention, while reference has been made to soldering wiring connections, gluing, boding, crimping, clipping, twisting, wire wrapping or another approach may be employed. Still, however constructed, it is preferred that the base of each LED is held close to or against the front of the backing by constraining at least one electrode from each on the opposite side of the backing. In this regard, the LEDs are most effectively held against baking 6 when the openings 12 the electrodes pass through are oriented in-line with the axis they define. Slit-style openings, such as produced using a simple blade are easily made and help hold the electrodes by compression during prop fabrication. Regardless, the orientation of the openings may vary as well as their shape as alluded to above.

Once a fire is lit in the monster's eyes by connecting a battery, it will continue to burn until the connection is terminated or the creature's time runs out. The connection may be terminated by removing the battery or by a switch included in the system. Other componentry additions may include circuitry to make the "eyes" blink. Otherwise blinking can be accomplished with specially adapted LEDs. In any event, the basic variations of the invention shown in the figures are the most preferred. These "bare-bones" embodiments of the invention provide the best value to consumers.

Claims

It is to be understood that various examples of the invention have been portrayed or described, but they are not intended to limit the scope of the invention. Various modification of the invention as would be contemplated by those with skill in the art are intended to be covered herein. The breadth of the present invention is to be limited only by the literal or equitable scope of the following claims.

That being said, I claim:

1. An entertainment prop comprising:

a substantially flat or low-relief backing depicting at least a head of a being and a pair LEDs to simulate eyes, each LED comprising a base positioned adjacent a portion of said backing, each LED further comprising a pair of electrodes passing through an opening in said backing, an electrical connection crossing said backing between at least one of each of said pair of electrodes wherein said LEDs are connected in electrical parallel to hold a battery between said electrodes, said crossing connection, in cooperation with each said LED base, securing said LEDs to said backing.

2. The prop of claim 1, wherein a full figure of said being is depicted.

3. The prop of claim 1, wherein said head is selected from a group consisting of skulls, jack-o-lanterns and ghost, devil, reaper, witch, warlock, Frankenstein, ghoul, goblin, mummy, zombie, werewolf, vampire and leper heads.

4. The prop of claim 1, wherein said crossing connection is provided only by said electrodes.

5. The prop of claim 1, wherein said electrodes are positioned to form a cradle for a battery.

6. The prop of claim 1, further comprising a battery.

* * * * *